US007112167B2

(12) United States Patent
Kim

(10) Patent No.: US 7,112,167 B2
(45) Date of Patent: Sep. 26, 2006

(54) EXERCISE APPARATUS

(76) Inventor: Hyung Jun Kim, #101-402 Cheonggu-3cha Apt., 360-2, Junggye-1dong, Nowon-gu, Seoul 139-924 (KR)

( * ) Notice: Subject to any disclaimer, the term of this patent is extended or adjusted under 35 U.S.C. 154(b) by 0 days.

(21) Appl. No.: 10/915,945

(22) Filed: Aug. 11, 2004

(65) Prior Publication Data

US 2006/0035773 A1 Feb. 16, 2006

(51) Int. Cl.
*A63B 26/00* (2006.01)

(52) U.S. Cl. ..... 482/145; 482/144

(58) Field of Classification Search ..... 482/143–145; D21/688–690

See application file for complete search history.

(56) References Cited

U.S. PATENT DOCUMENTS 3,589,358 A * 6/1971 Megal ..... 606/244
4,113,250 A * 9/1978 Davis ..... 482/144
4,232,662 A 11/1980 Barber
D269,543 S * 6/1983 Walper et al. ..... D24/183
4,494,532 A * 1/1985 Masuda et al. ..... 482/38
4,494,533 A * 1/1985 Sgroi et al. ..... 606/241
5,551,937 A * 9/1996 Kwo ..... 482/144
5,575,745 A 11/1996 Lin
6,149,560 A 11/2000 Kim
6,767,314 B1 * 7/2004 Thompson ..... 482/96

* cited by examiner

*Primary Examiner*—Lori Amerson
(74) *Attorney, Agent, or Firm*—The Webb Law Firm

(57) ABSTRACT

An exercise apparatus with both a mat rotating means operated by an electric motor and a foot support means to allow a user reclining on a mat to hang his/her body upside down from the foot support means or to do exercises, such as sit-ups, without help from another person. In the exercise apparatus of the present invention, the leg assembly includes movable and immovable legs, in which the movable leg is closed towards the immovable leg to close the leg assembly in an effort to increase space efficiency of the apparatus. The exercise apparatus also has a locking means for causing the leg assembly in a closed state to be maintained in a stable position, and a plurality of rollers mounted to an outside portion of either leg of the leg assembly to cause a user to easily move the heavy exercise apparatus when necessary.

2 Claims, 10 Drawing Sheets

Prior Art

EXERCISE APPARATUS

BACKGROUND OF THE INVENTION

1. Field of the Invention

The present invention relates, in general, to exercise apparatuses and, more particularly, to an exercise apparatus with both a mat rotating means operated by an electric motor and a foot support means to allow a user reclining on a mat to hang his/her body upside down from the foot support means or to do exercises, such as sit-ups, without help from another person.

2. Description of the Prior Art

The present invention has been studied and invented, based on U.S. Pat. No. 6,149,560 (herein below, referred to simply as "No. '560") that was filed by the inventor of the present invention, entitled "exercise device".

The construction of the exercise device of No. '560 is shown in FIG. 1 of the accompanying drawings.

The exercise device of No. '560 includes a base frame 20 with both a first leg 21 and a second leg 22 serving as a support base to support the exercise device on a support surface as shown in FIG. 1. The exercise device further includes: a mat 1 on which a user lies reclined; a mat frame 2 rotatably mounted to an upper end of the base frame 20, with the mat 1 supported by the mat frame 2; a mat rotating means 4 having a motor to rotate the mat frame 2; and a bearing unit 7 rotatably coupled to the mat frame 2. Furthermore, a length-adjustable extension member 8 is mounted to a longitudinal end of the mat frame 2, with a foot support means 10 mounted to a free end of the extension member 8 to support the feet and ankles of the user reclining on the mat 1.

The foot support means 10 includes: a pair of footholds 11 mounted to the free end of the extension member 8 while extending laterally horizontally in opposite directions to support the weight of the user reclining on the mat 1; and a pair of calf support bars 12 mounted to the extension member 8 at a position near the free end of the member 8 while extending laterally and horizontally in opposite directions to support the calves of the user's legs. The foot support means 10 further includes: a pair of ankle holders 13 which is rotatably coupled to the free end of the extension member 8 by means of a swinging bar 14; and an ankle holder rotating means 15 which rotates the ankle holders 13 towards the calf support bars 12 so as to support the ankles of the user. The ankle holder rotating means 15 is installed in the footholds 11.

The mat rotating means 4 and the ankle holder rotating means 15 are provided with a first reversible motor 5 and a second reversible motor (not shown), respectively. A reduction gear assembly 6 is provided in the mat rotating means 4 to reduce the output speed of the first reversible motor 5. The ankle holder rotating means 15 has a reduction gear assembly (not shown) in the same manner as that described for the gear assembly 6 of the mat rotating means 4. Thus, the rotating forces of the first and second motors are transmitted to a rotating member 3 of the mat frame 2 and the rotating bar 14 of the ankle holder 13, respectively, through the reduction gear assemblies, and thus, both the mat frame 2 and the ankle holders 13 rotate.

In the meantime, two switches S1 and S2 are provided on the upper portion of the outer surface of a casing that covers the mat rotating means 4. Of the two switches, the first switch S1 controls operation of the first motor 5 provided in the mat rotating means 4, and thereby controls the inclination angle of the mat 1. Furthermore, the second switch S2 controls operation of the second motor (not shown) provided in the ankle holder rotating means 15, and thereby controls the rotating angle of the ankle holders 13. Thus, when using the above-mentioned exercise device, the user lying reclined on the mat 1 easily controls the inclination angle of the mat 1 by manipulating the switches. Furthermore, the user stops the motor of the mat rotating means 4 when the mat 1 is placed at a desired inclination angle. After the mat 1 is stopped at the inclination angle, the user does desired exercises, such as sit-ups, on the mat 1. In the drawing, the reference numeral 9 denotes a handgrip that extends from the rotating member 3 of the mat frame 2.

The above-mentioned exercise device is advantageous in that a user conveniently controls operation of the device. However, the exercise device is problematic in that the base frame 20 including the first and second legs 21 and 22 has a fixed structure which does not allow the legs 21 and 22 to be closed or disassembled, although the legs 21 and 22 firmly fixed to each other can stably support the device on a support surface. Thus, the exercise device must occupy a substantial predetermined space even when the device is not in use, thus reducing space efficiency.

Furthermore, to move the exercise device, two or more persons must handle the heavy device at the same time.

Another disadvantage of the above-mentioned exercise device is that the device does not have any means for manually rotating the mat frame when interruption of electric power occurs while the device is in use. Thus, if the power gives out while the user's body is hanging upside down from the foot support means, the mat frame cannot return to its horizontal position, sometimes causing safety hazards.

SUMMARY OF THE INVENTION

Accordingly, the present invention has been made keeping in mind the above problems occurring in the prior art, and an object of the present invention is to provide an exercise apparatus with a folding structure capable of improving space efficiency of the device.

Another object of the present invention is to provide an exercise apparatus that can be easily moved by a user when necessary.

A further object of the present invention is to provide an exercise apparatus that is provided with a manual actuating means to rotate a mat frame when interruption of electric power that stops automatic operation of the mat frame occurs while the apparatus is in use.

In order to achieve the above objects, according to one aspect of the present invention, there is provided an exercise apparatus comprising a leg assembly; a mat frame for supporting a mat on which a user lies or reclines, the mat frame being rotatably mounted to an upper end of the leg assembly by means of motor-operated mat rotating means and a bearing unit; and a foot support means mounted to a longitudinal end of the mat frame so as to support the feet and ankles of the user lying or reclining on the mat.

The leg assembly may comprise a movable leg and an immovable leg rotatably coupled together at upper ends thereof.

The exercise apparatus may further comprise: a skirt interposed between the leg assembly and each of the mat rotating means and the bearing unit to support the mat rotating means and the bearing unit on the leg assembly, with an upper portion of the immovable leg securely supported in one side of the skirt, and an upper portion of the movable leg supported in the other side of the skirt to be movable towards the immovable leg; a reinforcing folding frame horizontally coupled between the movable leg and the immovable leg so that one end of the reinforcing folding frame is rotatably coupled to the movable leg, and the other link is rotatably coupled to the immovable leg, with a center of the reinforcing folding frame being constructed to be able to fold; and a locking means for causing the movable leg closed towards the immovable leg to be locked at a predetermined position.

The locking means may comprise: a locking hole formed on the upper portion of the movable leg at a predetermined position; and a locking protrusion provided on the skirt to elastically protrude from the skirt by means of a spring at a predetermined position along a moving path of the locking hole which is defined by a movement of the movable leg, so that, when the movable leg is closed towards the immovable leg, the locking protrusion is inserted into the locking hole.

The exercise apparatus may further comprise: a tool insert hole formed through a housing of the mat rotating means to reach an output shaft of a motor of the mat rotating unit from an outside; and a polygonal countersink formed on an outside end of the shaft of the motor which is exposed to the outside through the tool insert hole.

The exercise apparatus may further comprise: rollers mounted to an outside portion of a support beam part connecting lower ends of the movable leg to each other or to an outside portion of another support beam part connecting lower ends of the immovable leg to each other.

BRIEF DESCRIPTION OF THE DRAWINGS

The above and other objects, features and other advantages of the present invention will be more clearly understood from the following detailed description when taken in conjunction with the accompanying drawings, in which:

FIGS. 5 and 6 are views illustrating a closing structure of the exercise apparatus of FIG. 2, in which:

FIG. 5 illustrates a state of the closing structure before the apparatus is closed; and FIG. 5 illustrates a state of the closing structure after the apparatus is closed;

FIGS. 7 and 8 are sectional views taken along the line A—A of FIG. 6, in which:

FIG. 7 illustrates a state in which a locking protrusion of a locking unit is inserted into a locking hole; and FIG. 8 illustrates a state in which the locking protrusion is removed from the locking hole;

DETAILED DESCRIPTION OF THE INVENTION

Figure 1:
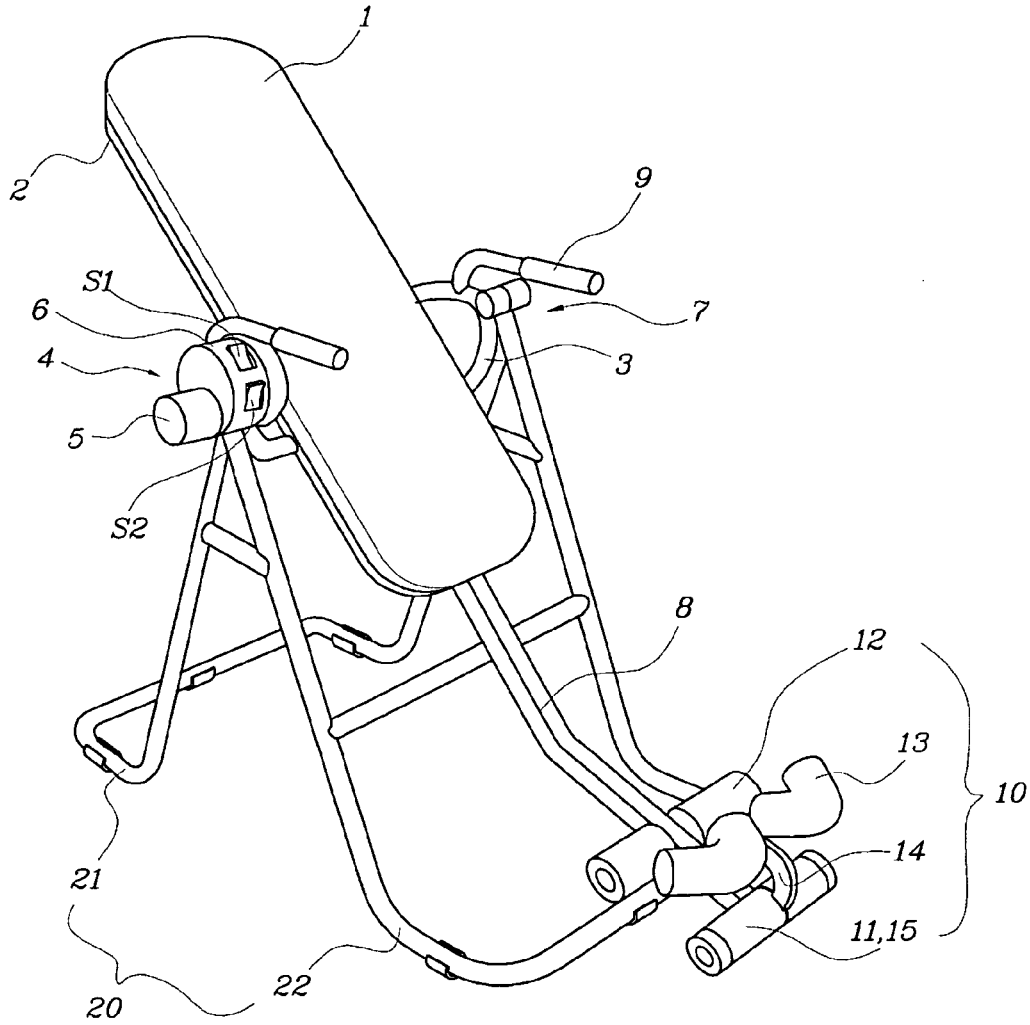
FIG. 1 is a perspective view illustrating a conventional exercise apparatus.

Reference will now be made in greater detail to a preferred embodiment of the invention, an example of which is illustrated in the accompanying drawings. Wherever possible, the same reference numerals will be used throughout the drawings and the description to refer to the same or like parts. Furthermore, because the present invention is invented based on the Patent of No. '560, the elements of the present invention analogous to those of No. '560 will carry the same reference numerals as No. '560 and will not be described in detail in the following description.

Figure 2:
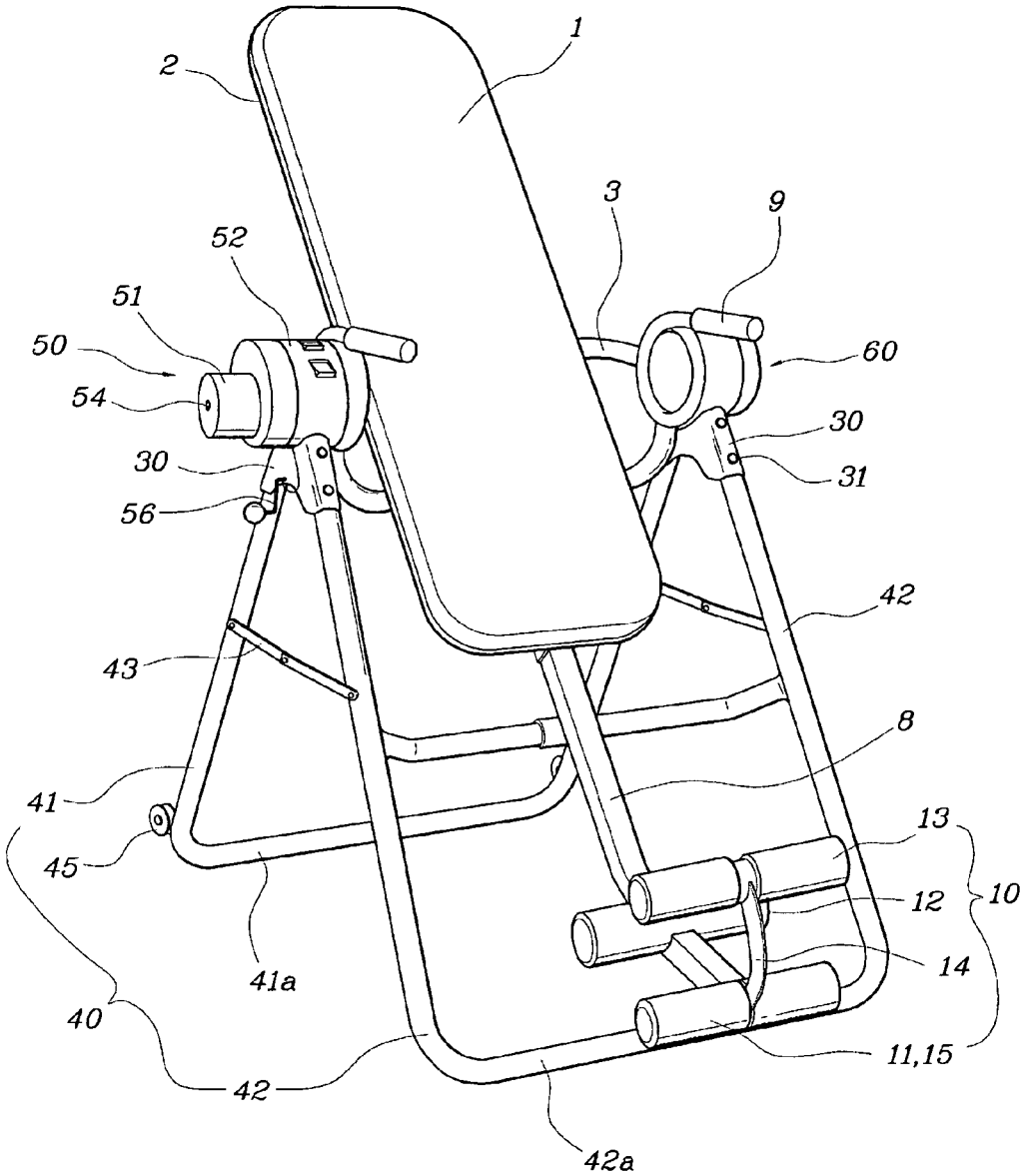
FIG. 2 is a perspective view illustrating an exercise apparatus according to an embodiment of the present invention.
Figure 3:
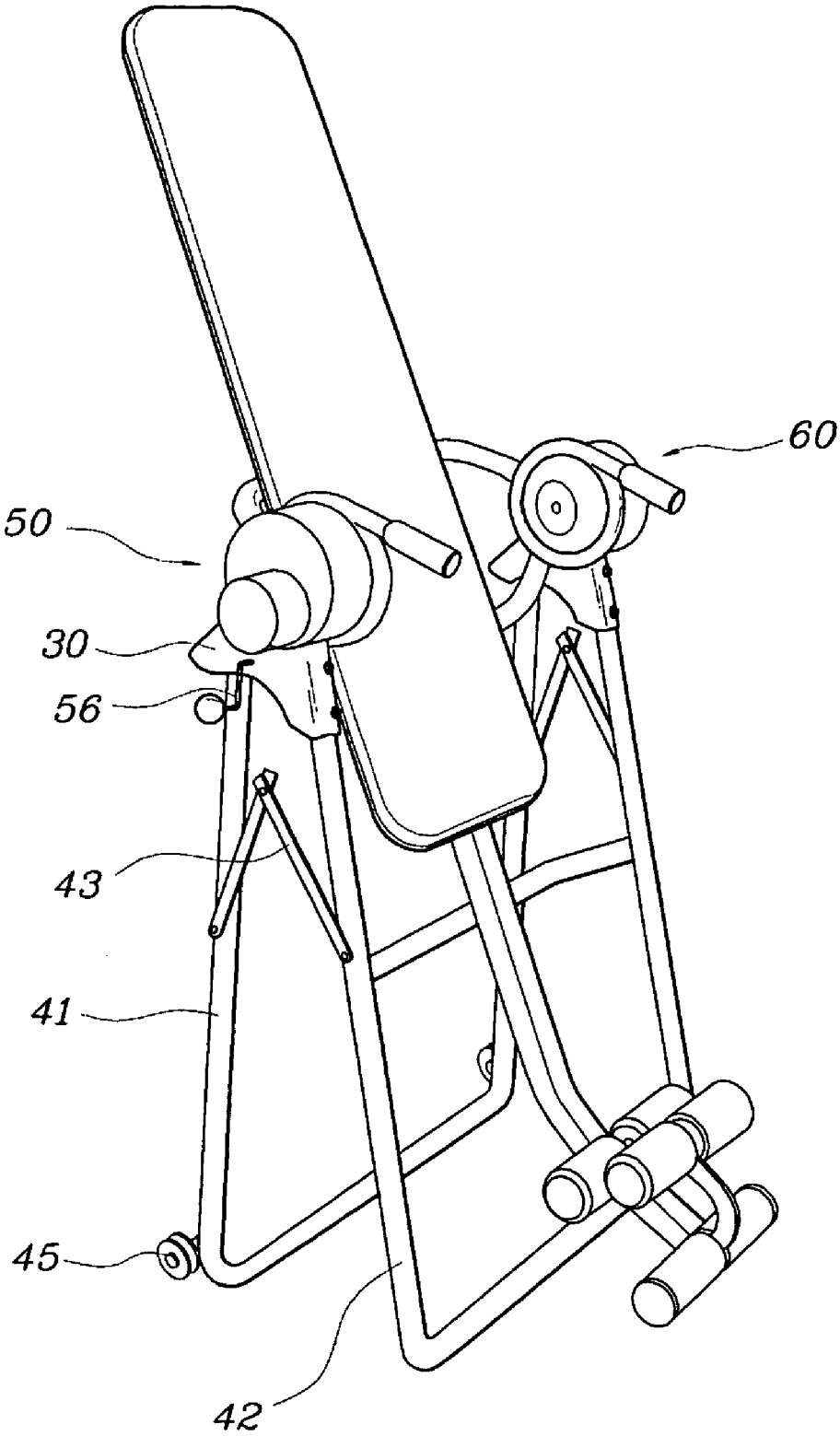
FIG. 3 is a perspective view illustrating the exercise apparatus of FIG. 2 in a closed state when viewing the apparatus from the left.
Figure 4:
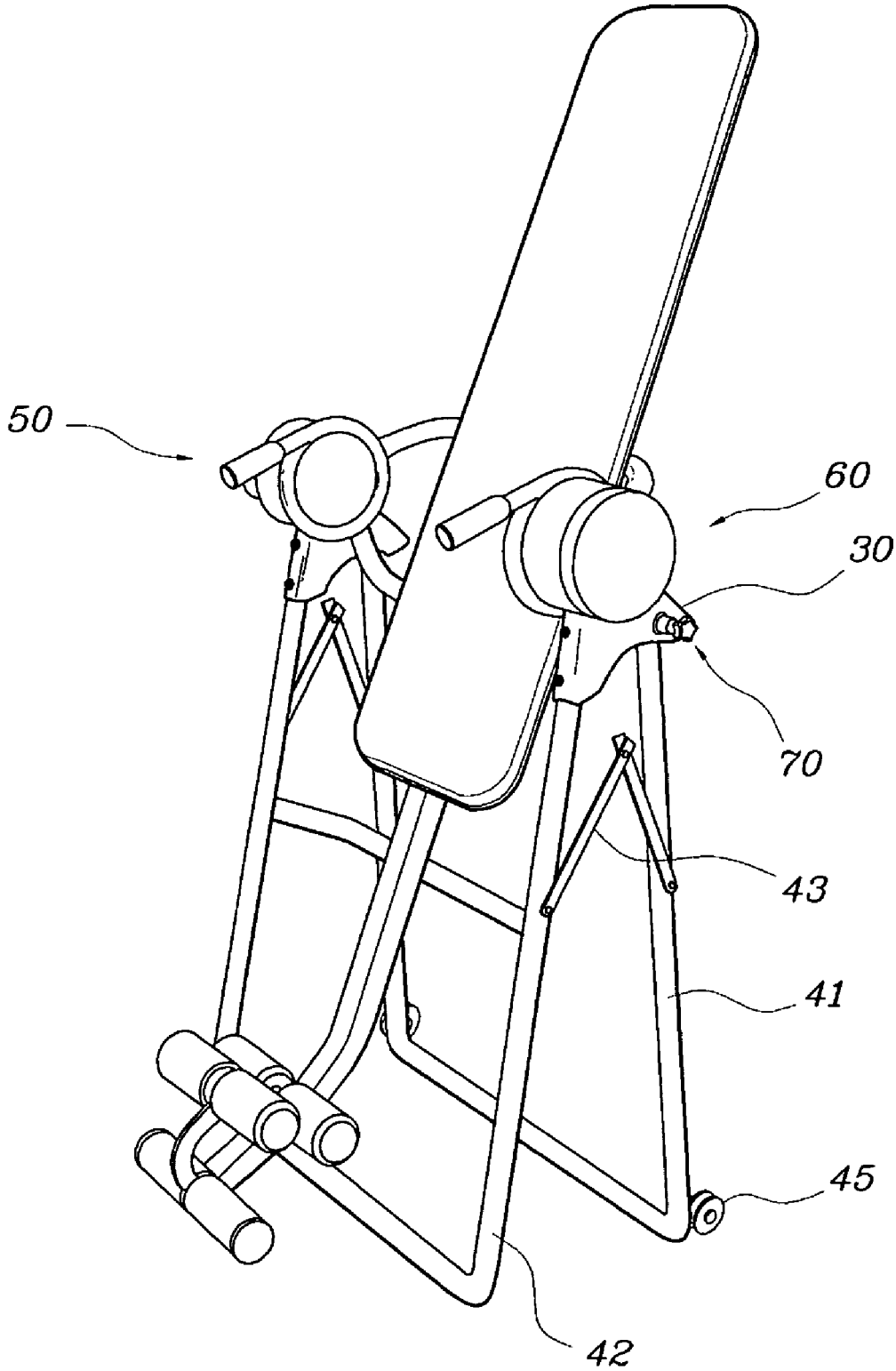
FIG. 4 is a perspective view illustrating the exercise apparatus of FIG. 2 in the closed state when viewing the apparatus from the right.
Figure 5:
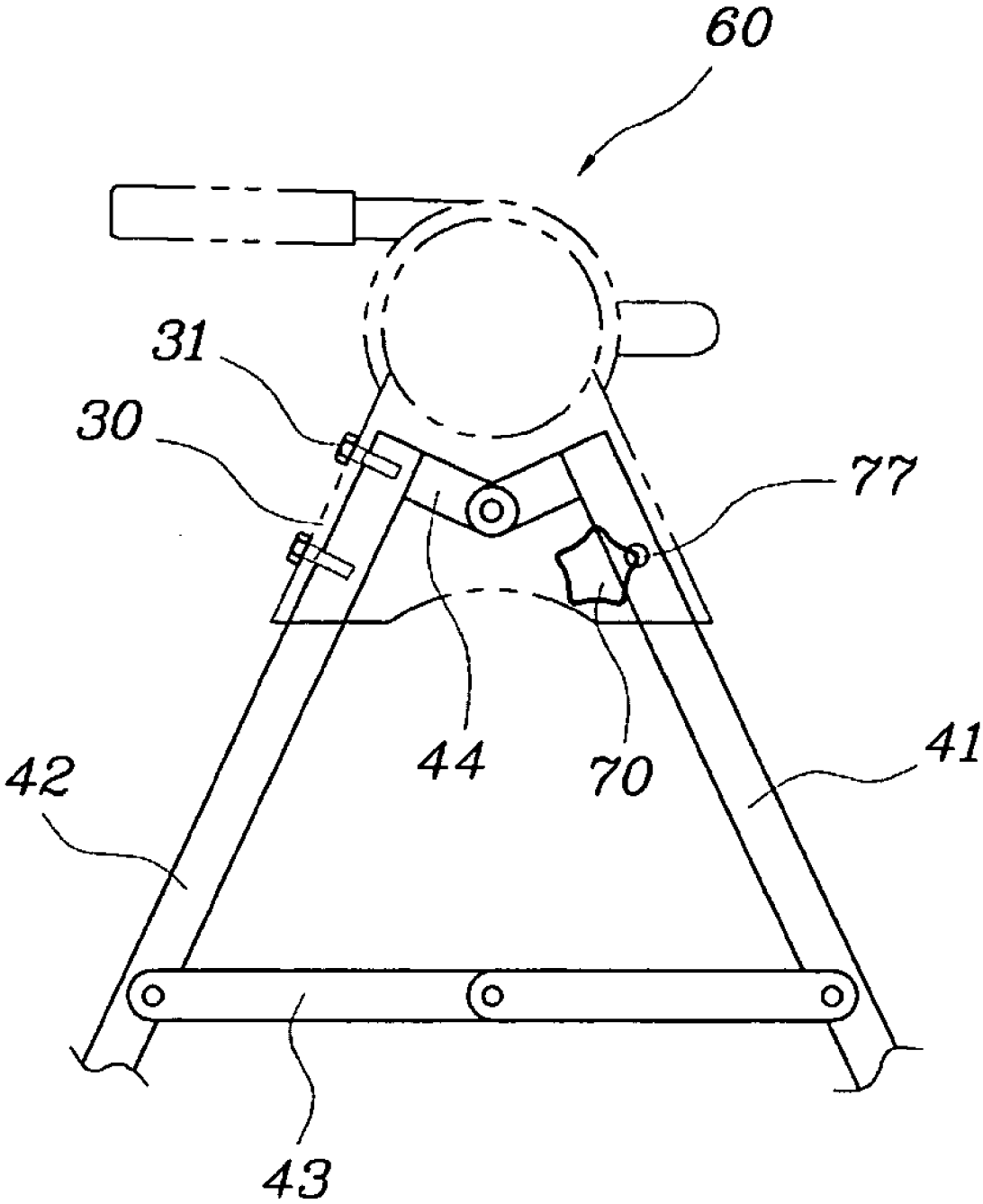
Figure 6:
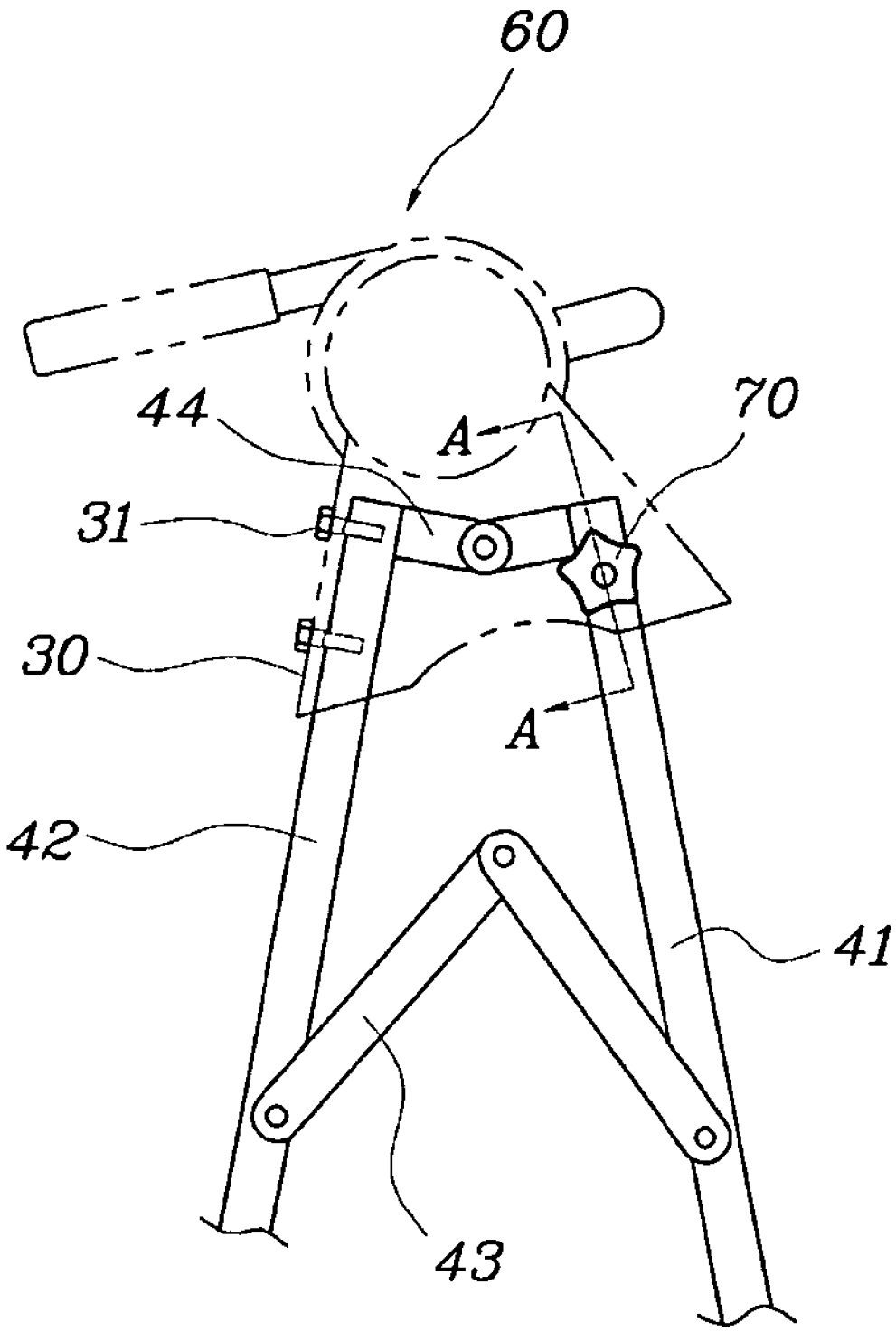

As shown in FIGS. 2 to 4, the exercise apparatus according to a preferred embodiment of the present invention includes a leg assembly 40 serving as a support base to support the exercise device on a support surface. The leg assembly 40 comprises a movable leg 41 and an immovable leg 42 which are rotatably coupled to each other at upper ends thereof. Particularly, the movable leg 41 of the leg assembly 40 rotates relative to the immovable leg 42 around the jointed upper end to be closed towards or opened away from the immovable leg 42.

The left-hand side arms of the movable and immovable legs 41 and 42 support a mat rotating means 50 by means of a skirt 30, while the right-hand side arms of the movable and immovable legs 41 and 42 support a bearing unit 60 by means of another skirt 30. In other words, one skirt 30 is interposed between the leg assembly 40 and each of the mat rotating means 50 and the bearing unit 60.

The construction of the leg assembly 40 and the skirt 30 will be described in detail herein below with reference to FIGS. 2 to 6.

The leg assembly 40 has a structure in which the movable leg 41 and the immovable leg 42 each comprising a U-shaped frame lean on each other to be supported, with a hinged connecting member 44 provided between the upper ends of the movable and immovable legs 41 and 42 to connect the two legs 41 and 42 together at each side of the leg assembly 40. The connecting member 44 comprises two arms jointed together by a hinge, so that the two arms of the connecting member 44 can rotate around the hinged joint to be opened or closed. In that case, one arm of the connecting member 44 is securely mounted to the upper end of the movable leg 41, while the other arm is securely mounted to the upper end of the immovable leg 42. Thus, when the movable leg 41 moves towards the immovable leg 42, the arm of the connecting member 44 mounted to the movable leg 41 rotates around the hinged joint to be closed toward the arm mounted to the immovable leg 42. The leg assembly 40 is thus closed. This connecting member 44 connecting the two legs 41 and 42 enables the leg assembly 40 to endure external load (due to the mat, mat frame and user) more effectively.

Coupled to the middle portions of the movable and immovable legs 41 and 42 at each side of the leg assembly 40 is a reinforcing folding frame 43 which increases the structural strength of the leg assembly 40 to allow the leg assembly 40 to effectively endure external load and ensures a desired structural stability of the exercise apparatus. The reinforcing folding frame 43 comprises two links jointed together by a hinge, so that the two links of the frame 43 can rotate around the hinged joint to be opened or closed in the same manner as that described for the connecting member 44. In that case, one link of the reinforcing folding frame 43 is coupled by a hinge to the middle portion of the movable leg 41, while the other link is coupled by another hinge to the immovable leg 42. Thus, the two links of the reinforcing folding frame 43 can rotate relative to each other around the hinged joint to be closed or opened.

The lower ends of the movable and immovable legs 41 and 42 each comprise a support beam part 41*a*, 42*a* which connect the lower ends of the two arms of each of the movable and immovable legs 41 and 42 to each other while extending horizontally, with two rollers 45 mounted to the outside portion of the support beam part 41*a* of the movable leg 41. In that case, the location of the two rollers 45 must be such that any load is not applied to the rollers 45 in an opened state of the leg assembly 40 in which the leg assembly 40 stably supports the mat frame 2 as shown in FIG. 2 or a balanced closed state of the leg assembly 40 as shown in FIGS. 3 and 4. However, the determination of the location of the rollers 45 is also based on the design factor that, when the exercise apparatus in the closed state of the leg assembly 40 leans toward the rollers 45 at a predetermined angle, a load must be applied to the rollers 45. If the location of the rollers 45 is determined as described above, a user easily and conveniently moves the heavy exercise apparatus.

The upper end of the leg assembly 40 having the above-mentioned support structure is stably supported by a skirt 30 at each side thereof. In a detailed description, at each side of the upper end of the leg assembly 40, the upper portion of one arm of the immovable leg 42 is securely supported in one side of the skirt 30 by being tightened by locking bolts 31, while the upper portion of a corresponding arm of the movable leg 41 is supported in the other side of the skirt 30 to be movable toward the immovable leg 42.

In that case, the skirt 30 serves as a stopper that determines the angular moving range of the movable leg 41 relative to the immovable leg 42, thus limiting the maximum opening angle of the movable leg 41 relative to the immovable leg 42. The skirt 30 also serves as a leg support that maintains a stable position of the leg assembly 40 when the movable leg 41 is opened away from the immovable leg 42 at the maximum angle.

Thus, the exercise apparatus can keep its stability by virtue of the structure of the leg assembly having the connecting member 44, reinforcing folding frame 43 and skirt 30, even though the movable leg 41 is not securely fastened to the skirt 30 by a locking bolt.

Herein below, the structure for closing or opening the leg assembly 40 and a locking means for causing the leg assembly 40 in a closed state to be maintained in a stable position will be described in conjunction with FIGS. 4 to 8.

As described above, unlike the immovable leg 42 securely supported in the skirts 30, the movable leg 41 is movably supported in the skirts 30. Thus, when a user moves the movable leg 41 toward the immovable leg 42 while slightly raising the movable leg 41 from a support surface, the reinforcing folding frame 43 and the connecting member 44 are closed around their hinged joints, and thereby, the movable leg 41 is closed toward the immovable leg 42. In that case, the closed movable leg 41 may be fixed in a predetermined position by the locking means as shown in FIGS. 5 to 8.

The locking means comprises a locking hole 77 that is formed on the upper portion of the movable leg 41 at a position to support the bearing unit 9 thereon, and a locking unit 70 that is provided in the skirt 30 at a position corresponding to the locking hole 77. The locking unit 70 has a locking protrusion 71 that is provided on the skirt 30 to elastically protrude from the skirt 30 by means of a spring 73 at a predetermined position along a moving path of the locking hole 77 which is defined by a movement of the movable leg 41. Thus, when the movable leg 41 is closed towards the immovable leg 42, the locking protrusion 71 of the locking unit 70 is inserted into the locking hole 77.

Figure 7:
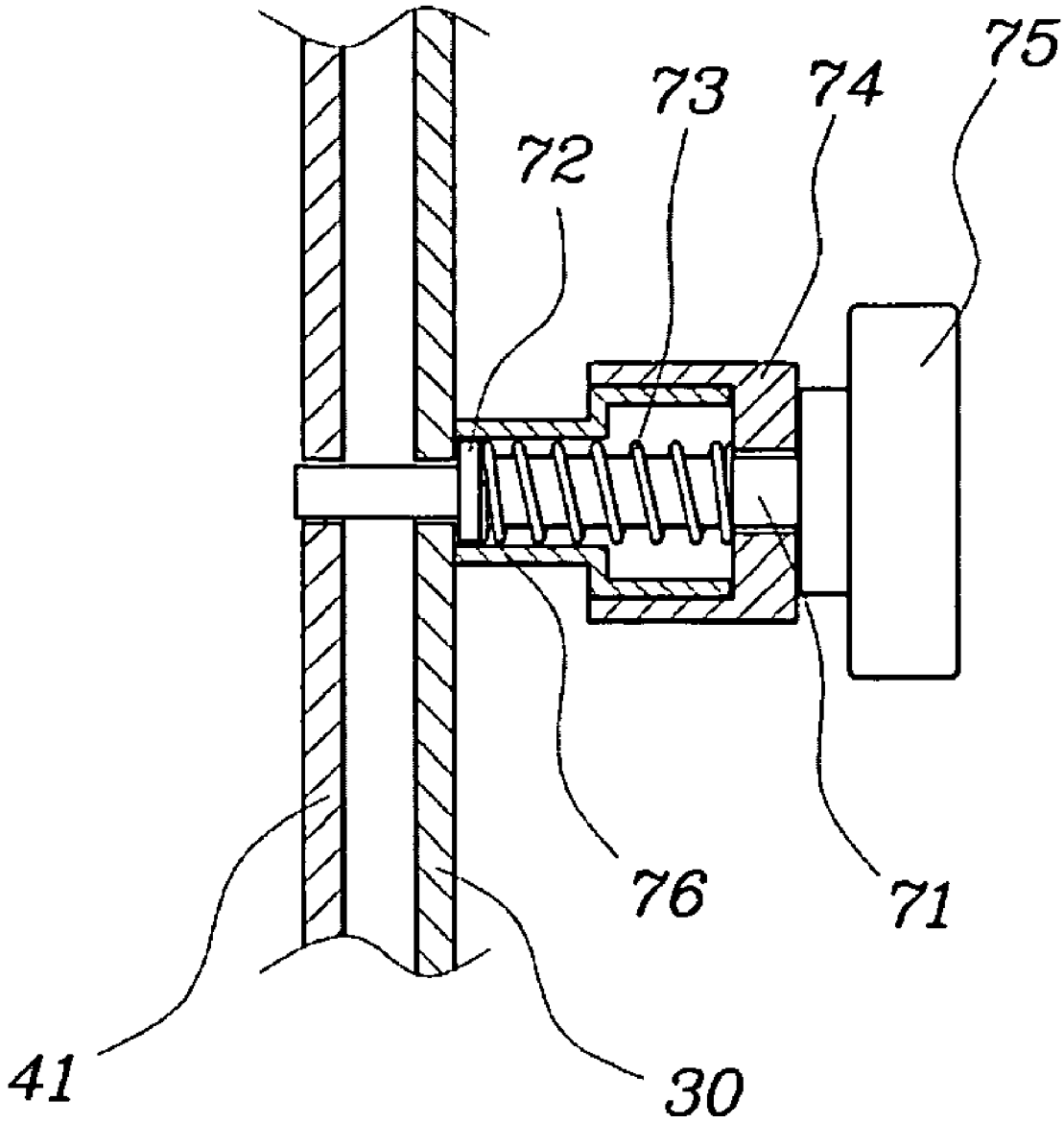
Figure 8:
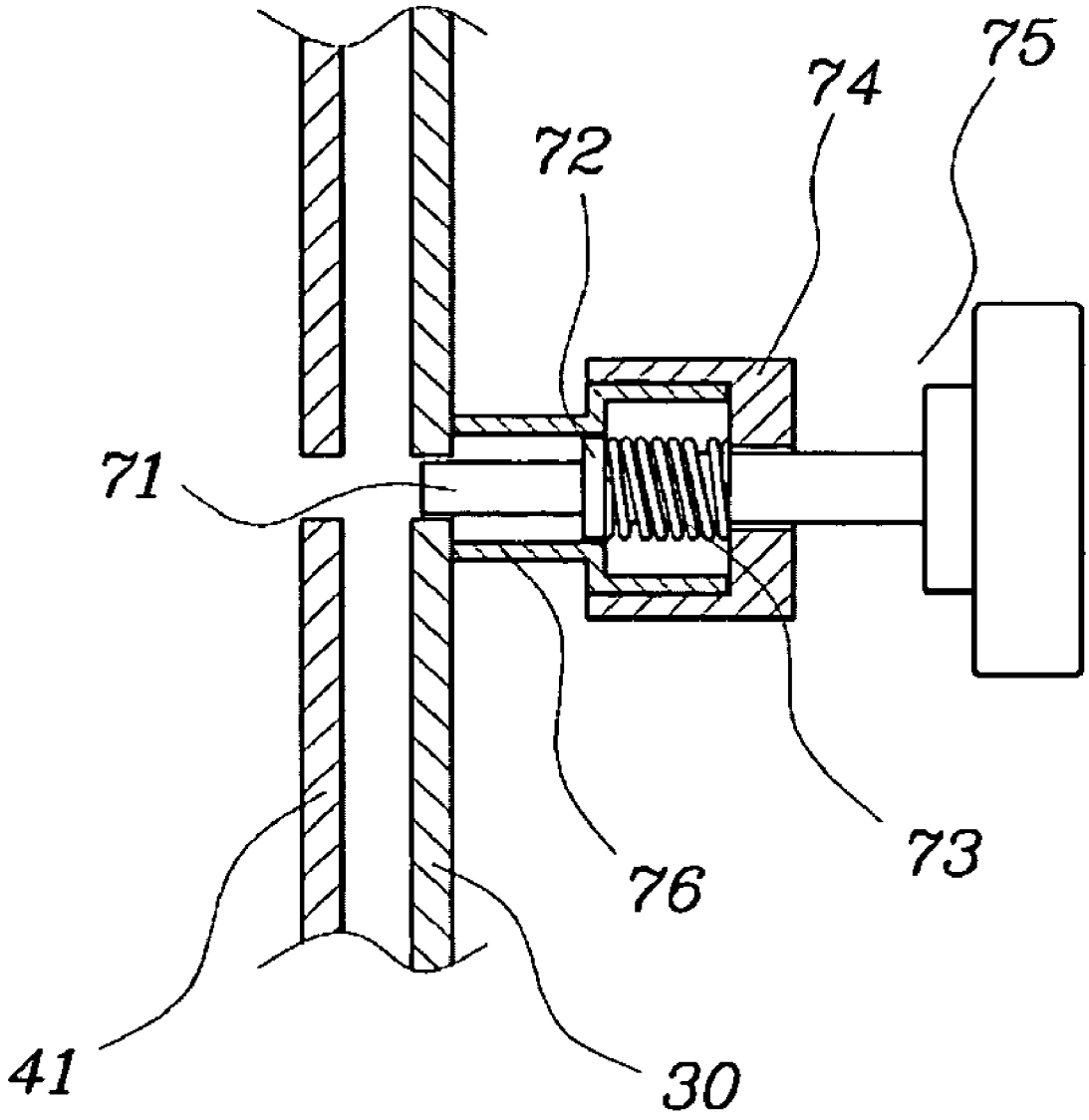
Figure 9:
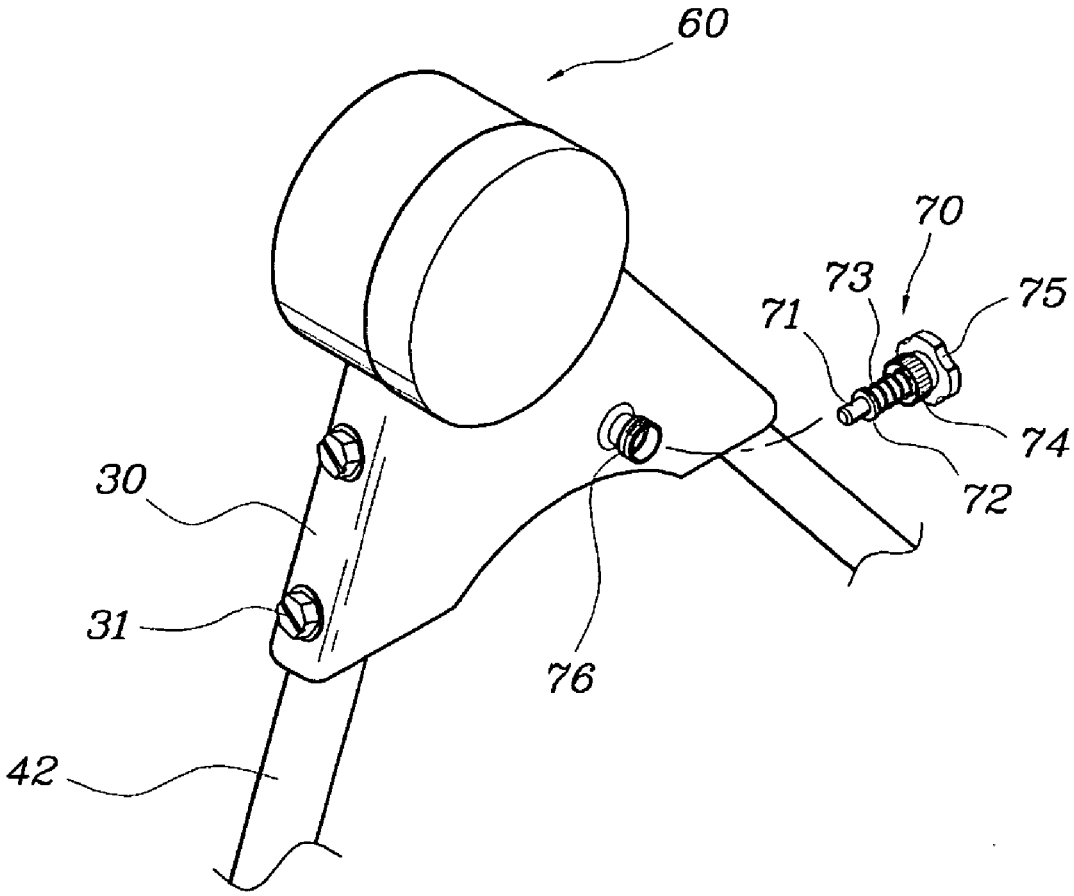
FIG. 9 is a perspective view illustrating the construction of the locking unit of the exercise apparatus of FIG. 2.

As shown in FIGS. 7 to 9, the locking unit 70 is mounted to the skirt 30 by a screw-type engagement of a second stopper 74 of the locking unit 70 with a mounting bracket 76 which is fixed to the skirt 30. When a control knob 75 of the locking unit 70 which is mounted to the skirt 30 is pulled backwards by the user, the locking protrusion 71 moves in the same direction. In that case, a first stopper 72 which is integrated with the locking protrusion 71 moves along with the locking protrusion 71, while the above-mentioned second stopper 74 which is screwed to the mounting bracket 76 is in an immovable state. Due to the above-mentioned structure, elastic restoring force of the spring 73 placed between the first and second stoppers 72 and 74 is applied to the locking protrusion 71.

Thus, during a closing motion of the movable leg 41, the movable leg 41 pushes the locking protrusion 71 backward from its position. When the movable leg 41 is completely closed, the locking protrusion 71 elastically goes back forwards to its original position to be inserted into the locking hole 77 by means of the elastic restoring force of the spring 73. Due to the above-mentioned structure, the exercise apparatus of the present invention maintains its stable state even when the apparatus is in a closed state as shown in FIGS. 3 and 4.

To open the exercise apparatus, the user moves the movable leg 41 away from the immovable leg 42 to open the leg assembly 40 while pulling the control knob 75 with a hand.

As shown in FIG. 2, a motor-operated mat rotating means 50 and a bearing unit 60 are firmly supported on the upper ends of the two skirts 30 by welding (particularly, the welding is executed along the junctions between the upper ends of the skirts and the lower ends of housings of the mat rotating means and the bearing unit).

The mat rotating means 50 comprises a first motor 51 and a reduction gear assembly 52 coupled to the output shaft of the first motor 51, and thus rotates a rotating member 3 to finally rotate the mat frame 2 by a combination of the motor 51 and the gear assembly 52.

Figure 10:
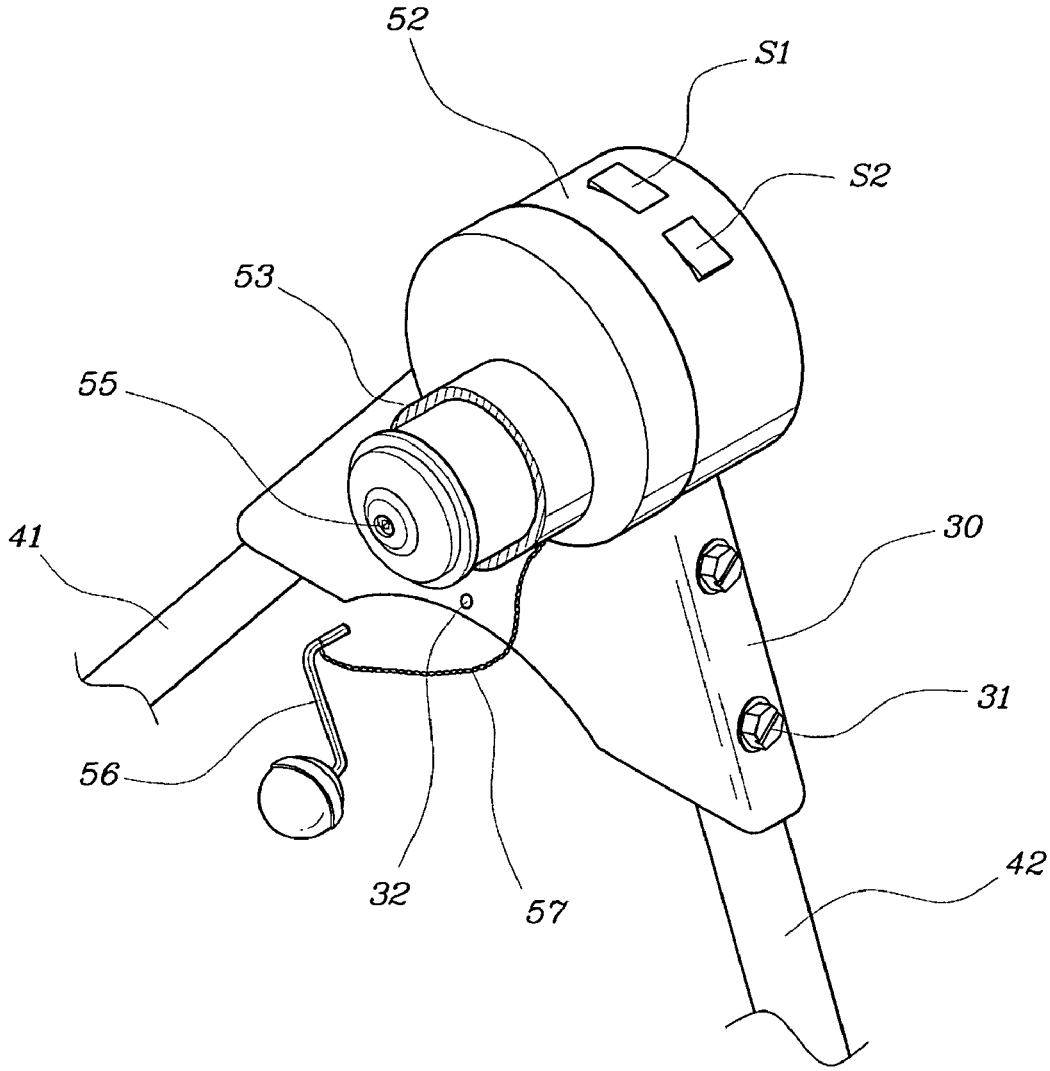
FIG. 10 is a partially broken perspective view illustrating an adjusting structure provided in the exercise apparatus of FIG. 2 to be rotated by a hexagonal wrench, thus adjusting the rotating shaft of a first motor.

As shown in FIGS. 2 and 10, the housing 53 of the mat rotating means 50, which includes a motor housing of the first motor 51 and a gear housing of the reduction gear assembly 52, has a tool insert hole 54 that is formed through the housing 53 to reach the output shaft of the first motor 51. Thus, the output shaft of the first motor 51 is exposed to the outside of the housing 53 through the tool insert hole 54, with a hexagonal countersink 55 formed on the outside end of the output shaft of the first motor 51. When interruption of electric power occurs, stopping the automatic operation of the exercise apparatus occurs, the user inserts a hexagonal wrench 56 into the hexagonal countersink 55 of the output shaft of the first motor 51 through the tool insert hole 54 and rotates the output shaft of the first motor 51, thus manually rotating the mat frame 2 at a desired angle in a desired direction. To prevent the loss of the hexagonal wrench 56, the wrench 56 is preferably tied to the exercise apparatus with a cord 57 and, more preferably, the tied wrench 56 is fitted into a tool hole 32 provided on a side surface of the skirt 30 to allow the user to easily find the wrench when necessary.

The bearing unit 60 is rotatably coupled to the rotating member 3 of the mat frame 2, with a bearing (not shown) installed in the bearing unit 60 to cause smooth rotation of the rotating member 3. Furthermore, a sensor may be provided on the bearing unit 60 to control the maximum rotating angle of the mat frame 2. In other words, when the foot support means 10 comes into contact with a support surface by rotation of the first motor 51 or when the mat frame 2 is placed vertically, the maximum rotating angle of the mat frame 2 must be controlled to avoid further rotation of the mat frame 2 regardless of the operation of any switch S1 or S2. To achieve the above-mentioned object, the sensor is preferably provided in the bearing unit 60 to control the maximum rotating angle of the mat frame 2.

Although a preferred embodiment of the present invention has been described for illustrative purposes, those skilled in the art will appreciate that various modifications, additions and substitutions are possible, without departing from the scope and spirit of the invention as disclosed in the accompanying claims. For example, when the leg 42 of FIG. 2 is designed as a movable leg, while the leg 41 is designed as a immovable leg, the rollers may be mounted to the outside portion of the support beam part of the immovable leg to avoid any interference between the rollers and the foot support means.

As apparent from the above description, the exercise apparatus according to the present invention having the above-mentioned construction is advantageous in that a leg assembly of the apparatus can be closed to increase space efficiency of the apparatus when necessary. Furthermore, because rollers are provided on the leg assembly, the exercise apparatus with the closed leg assembly can be easily moved by a user.

Another advantage of the exercise apparatus is that a mat frame of the apparatus can be manually operated when necessary.

What is claimed is:

1. An exercise apparatus comprising a foldable leg assembly having movable and immovable legs of which upper ends are coupled together, a mat frame with a mat, a foot supporting unit, and a mat rotating unit for rotating the mat frame wherein the exercise apparatus comprises:

a mat rotating member provided on a side of the mat frame and a bearing member provided on the other side of the mat frame;

a motor attached to a gear reduction assembly for operating the mat rotating member;

a switch for operating the motor;

a length adjustable extension member mounted at one end to the mat frame;

a foot support means mounted to the other end of the length adjustable member;

a skirt placed on and covering the upper ends of the legs to stably support the mat rotating member and the bearing member, wherein an upper portion of the immovable leg is fixed to an inner side of the skirt and an upper portion of the movable leg is supported by a hinge in the other inner side of the skirt thereby defining a generally u-shaped frame wherein the movable leg is moved away from the immovable leg to the limit permitted by the skirt to define an operating configuration and wherein the movable leg is swung towards the immovable leg to define a folded configuration;

a reinforcing folding frame horizontally coupled between the movable leg and the immovable leg to reinforce the movable leg and the immovable leg when the legs are in the operating configuration;

a locking unit comprising;

a locking hole formed on an upper part of the movable leg, and a movable locking protrusion provided on the skirt and spring biased inwardly from the skirt to engage the locking hole, so that the leg assembly can stably stand in its folded configuration by inserting the locking protrusion into the locking hole and wherein the leg assembly can stand in its operating configuration by removing the locking protrusion from the locking hole and spreading apart the moving leg to the limit allowed by the skirt; and a tool insert hole formed through a housing of the mat rotating member to reach the output shaft of the motor of the mat rotating member from an outside, a polygonal countersink formed on an outside end of the shaft of the motor which is exposed to the outside through the tool insert hole; and a manual manipulating means provided in the mat rotating member to rotate manually the output shaft of the motor of the mat rotating member by using a tool which engages the polygonal countersink.

2. The exercise apparatus as set forth in claim 1, further comprising a roller mounted to an outside portion of a support beam part connecting one of:

lower ends of the movable leg to each other; and to an outside portion of another support beam part connecting lower ends of the immovable leg to each other.

* * * * *